US005335969A

United States Patent [19]

Yamaguchi et al.

[11] Patent Number: 5,335,969

[45] Date of Patent: Aug. 9, 1994

[54] CHAIR

[75] Inventors: Tomoshige Yamaguchi, Yokosuka; Nobuaki Nasu, Yokohama, both of Japan

[73] Assignee: Okamura Corporation, Japan

[21] Appl. No.: 904,857

[22] Filed: Jun. 26, 1992

[30] Foreign Application Priority Data

Jun. 26, 1991 [JP] Japan ..... 3-180463
Jun. 26, 1991 [JP] Japan ..... 3-180584

[51] Int. Cl.[5] ..... A47C 3/00

[52] U.S. Cl. ..... 297/301; 297/312; 297/340

[58] Field of Search ..... 297/301, 302, 312, 303, 297/329, 340

[56] References Cited

U.S. PATENT DOCUMENTS

| | | | |
|---|---|---|---|
| 3,989,297 | 11/1976 | Kerstholt | 297/312 X |
| 4,334,709 | 6/1982 | Akiyama et al. | 297/312 X |
| 4,521,053 | 6/1985 | de Boer | 297/312 |
| 4,695,093 | 9/1987 | Suhr et al. | 297/300 |
| 4,765,679 | 8/1988 | Lanuzzi et al. | 297/312 X |
| 5,069,496 | 12/1991 | Kunh et al. | 297/306 X |
| 5,203,606 | 4/1993 | Granzotto | 297/312 X |

FOREIGN PATENT DOCUMENTS

| | | |
|---|---|---|
| 56-66211 | 6/1981 | Japan . |
| 58-127617 | 7/1983 | Japan . |
| 60-170151 | 11/1985 | Japan . |
| 62-57519 | 3/1987 | Japan . |
| 63-23620 | 1/1988 | Japan . |
| 63-65810 | 3/1988 | Japan . |
| 2-24527 | 5/1990 | Japan . |

*Primary Examiner*—Peter M. Cuomo
*Assistant Examiner*—Jerry Redman
*Attorney, Agent, or Firm*—Hayes, Soloway, Hennessey, Grossman & Hage

[57] ABSTRACT

According to the present invention, there is provided a chair on which a sitter can take a comfortable and stable easy posture, without reducing the bending angle of his knee, despite inclining movements of the back rest and the seat of the chair.

23 Claims, 9 Drawing Sheets f0= VERTICAL LOAD OF THE UPPER BODY PART
f1= RESOLVED LOAD OF f0(EXERTED ON THE SITTING FACE)
f2= RESOLVED LOAD OF f0(EXERTED ON THE BACK)
f3= LOAD OBTAINED BY VERTICALLY RESOLVING f1
f4= LOAD OBTAINED BY HORIZONTALLY RESOLVING f1(A FORCE FOR SHIFTING THE BUTTOCKS FORWARD ALONG THE SITTING FACE)

PRIOR ART

PRIOR ART

CHAIR

BACKGROUND OF THE INVENTION

The present invention relates to a chair on which a person can sit in a comfortable state regardless of his posture, that is, a working posture or an easy posture.

In general, in order that the person can sit on the chair in the comfortable state regardless of the working posture or the easy posture, it is desirable that when the back rest and the seat of the chair incline backward, by which the person shifts to the easy posture, the back rest inclines at an angle larger than the inclined angle of the seat and a bending angle of the knee is increased while the leg is inclining backward centering on the ankle without reducing the bending angle between the thigh and the leg (from the knee to the ankle), that is, the bending angle of the knee.

However, in a conventional chair of which seat 101 and back rest 102 are formed integrally as shown in FIG. 9 or the seat and the back rest separately incline backward in cooperation, with each other, a fulcrum 103 on which the seat inclines has been set under the center of the seat. In the chair which is designed as mentioned above, the seat inclines backward greatly, the leading edge thereof gradually rises as the seat inclines backward, by which feet of a person get out of bed, the bending angle of the knee is reduced and hence no comfortable feeling in an easy posture has been expected.

As a solution thereof, Japanese Patent Laid-Open Pub. No. 58-127617 discloses a chair which is designed such that the leading edge of the seat hardly rises, by which the rising of the feet is prevented.

However, the chair described in the above-mentioned Japanese Patent Laid Open Pub. No. 58-127617 is of the type in which even though a person rests against the back rest, by which the seat is drawn and moved backward and the leg inclines backward centering on the ankle as a fulcrum, the seat slightly inclines downward centering on the horizontal axis of the seat front part as a fulcrum and hence it has such a drawback that the thigh inclines downward to a state which is imperfect to increase the bending angle of the knee and hence it becomes impossible to sit in a comfortable easy posture.

In addition, in the above-mentioned chair, the fulcrum on which the seat inclines is set on the front part of the seat, so that the inclining angle of the seat is smaller than that of the back rest in comparison with a chair in which the seat inclining fulcrum is set on the center of the seat and hence it becomes impossible to reduce a load which is resolved in a forward and horizontal direction of the sitting face by the load of the body upper part of a sitter, which induces such a problem that the buttocks are pushed forward to slide along the sitting face in association with the inclining movement of the back rest and hence it is impossible to stably support the buttocks by the seat rear part.

SUMMARY OF THE INVENTION

The present invention has been contemplated in view of the above-mentioned drawbacks associated with the prior art. Accordingly, an object of the present invention is to provide a chair by which a comfortable and stable easy posture can be taken without reducing the bending angle of the knee of a sitter in spite of inclining movement of the back rest and the seat of the chair.

In order to attain the above-mentioned object, a chair according to the present invention is constructed such that a forward facing base frame is fixedly provided at an upper end of a pillar of the chair, a lower part of a supporting lever provided with a back rest is movably and rotatably pivoted by a shaft which extends from side to side on a rear and underlying part of the base frame, a rear seat part of a seat Including a front seat part and the rear seat part in succession is connected to the supporting lever so as to cooperate with the supporting lever through a flexing part almost on the center which is oriented back and forth, and the front seat part is locked to a front part of the base frame without allowing inclining movement thereof so as to be movable only back and forth.

According to the chair of the present invention, when a person rests against the back rest in order to take an easy posture, the supporting lever turns and inclines backwards to incline the back rest backwards and the rear seat part which is linked with the supporting lever cooperates with the supporting lever to greatly incline backwards almost from the seat center which is oriented back and forth while moving backward centering on a shaft of the base frame as a fulcrum.

Owing to the above-mentioned movement, a load which is resolved in a forward and horizontal direction of the sitting face by the load of the upper body part of the sitter is reduced and hence the buttocks are prevented from being pushed forward along the sitting face in association with the inclining movement of the back rest, by which the buttocks of the sitter can take an easy posture stably supported by the rear seat part.

In addition, the front seat part which is flexibly linked with the rear seat part is locked to the front part of the back rest with no inclination so as to be movable only back and forth, so that the front seat part is pulled by the rear seat part almost horizontally with no inclination to be moved backward.

Owing to the above-mentioned movement, the thigh does not incline downward but the leg inclines backward centering on the ankle as a fulcrum, so that the bending angle of the knee is increased and hence it becomes possible to sit on the chair comfortably in all postures ranging from a working posture to an easy posture.

The novel features of the present invention are set forth with particularly in the appended claims. The invention will be best understood from the following description when read in connection with the accompanying drawings.

DESCRIPTION OF PREFERRED EMBODIMENTS OF THE INVENTION

Next, preferred embodiments of the present invention will be described with reference to the accompanying drawings.

Figure 1:
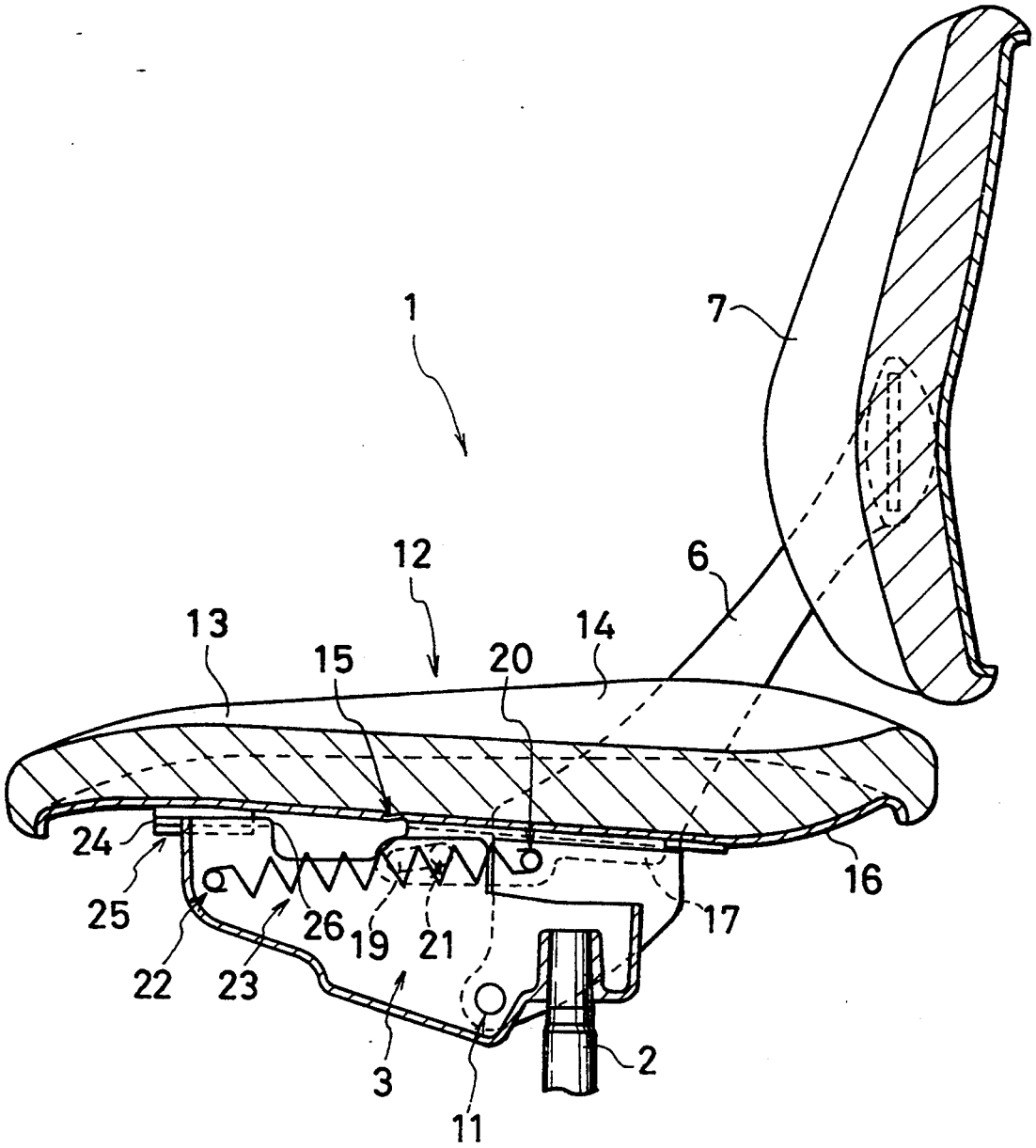
FIG. 1 is a side sectional view of a chair according to an embodiment of the present invention.
Figure 2:
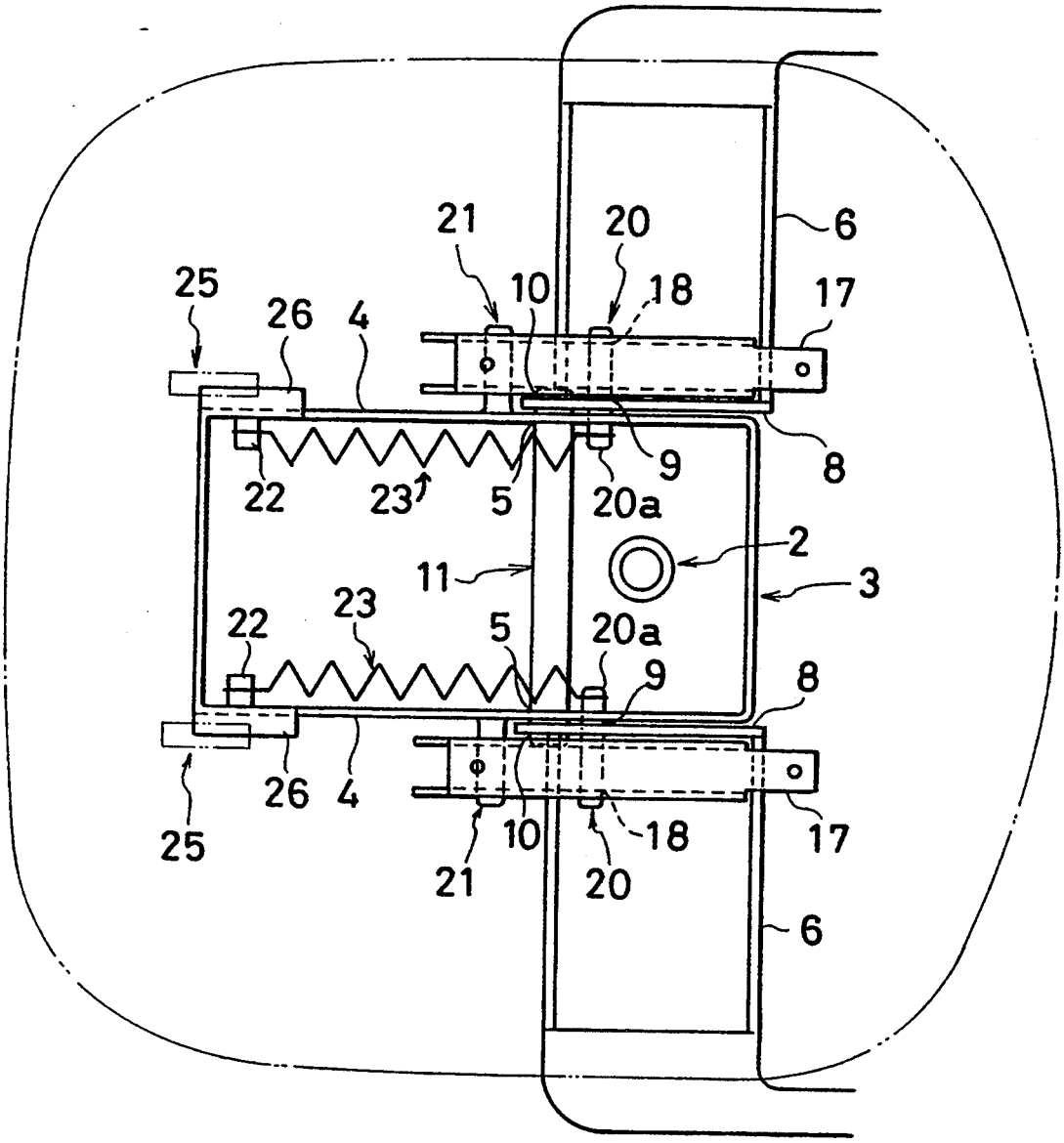
FIG. 2 is an essential plan view of the chair in Fig. 1.

In a chair 1 according to an embodiment of the present invention, as shown in FIGS. 1 and 2, an opentop forward facing base frame 3 is fixed to an upper end of a pillar 2 which is provided with a caster 8 (not shown) at a lower end thereof and shaft holes 5 and 5 are pierced in rear lowert parts of side plates 4 and 4 of the base frame 3. The numeral 6 denotes a supporting lever which is provided with a back rest 7 at an upper end thereof and a lower end thereof is forked off into two branches. Upper and lower shaft holes 9, 9, 10 and 10 are pierced in side plates 8 and of the supporting lever thus branched. The supporting lever 6 are movably and rotatably pivoted on the base frame 3 by inserting a shaft 11 into the lower shaft holes 10 and the shaft holes 5 in the base frame 3.

A seat 12 consists of a front seat 13 and a rear seat 14 which are flexibly linked with each other almost at the center therebetween. That is, a seat receiving seating 16 which is provided on the back surface of the seat includes a thin flexing part 15 which is provided almost at the center therebetween.

Rear seat receivers 17 17 are provided on both sides of the seat receiving seating 16 on the back surface of the rear seat 14 and a shaft hole 18 and a slot 19 are pierced in the receiver 17. The slot 19 is situated almost in the vicinity of the center of the seat 12.

The rear seat 14 is constructed to move, following the supporting lever 6 by inserting a shaft 20 to pass through the shaft hole 18 in the rear seat receiver 17 and the upper shaft hole 9 in the supporting lever 6 such that the rear seat receiver 17 and the supporting lever 6 are pivotally supported.

In this connection, it is to be noted that in this embodiment, an inner end 20*a* of the shaft 20 extends toward an inner side of the base frame 3.

The slot 19 is provided in a front part of the rear seat receiver 17. One end of a shaft 21 is loosely fitted into the slot 19 and the other end of the shaft is fixed to the side plate 4 of the base frame 3, by which the rear seat 14 is guided to an upper rear part of the base frame 3.

Projections 22 and 22 are fixedly provided on the front side plates 4 of the base frame 3. A spring member 23 for actuating the supporting lever 6 to return to its forward position is bridged between the projection 22 and the inner end 20*a* of the shaft 20 which connects the rear seat 14 with the supporting lever 6.

As an alternative, the spring member 23 may be provided directly between the base frame 3 and the rear seat 14 so as to actuate the rear seat 14 to return to its forward position.

Slide fittings 25 with grooves 24 which are elongated back and forth are attached on the right and left sides of the seat receiving seating 16 on the back surface of the front seat 13.

The elongated groove 24 in the slide fitting 25 is slidably fitted on a flange 26 which is provided on a front part of the base frame 3, by which the front seat 13 is locked to the front part of the base frame so as to be movable only back and forth with no inclination.

Accordingly, in an ordinary position (a working posture) in which the back rest 7 does not incline backward, the supporting lever 6 is actuated forward by the spring member 23 and hence a pin 21 is in abutment against the right end of the slot 19 as shown in FIG. 1.

On the other hand, when the back rest 7 is inclined backward, the rear seat 14 which cooperates with the supporting lever 6 is guided by the pin 21 and the slot 19. Then, when the pin 21 comes into abutment against the left end of the slot 19, further inclination of the back rest is restricted.

Next, the operation of the present invention will be described.

Figure 3:
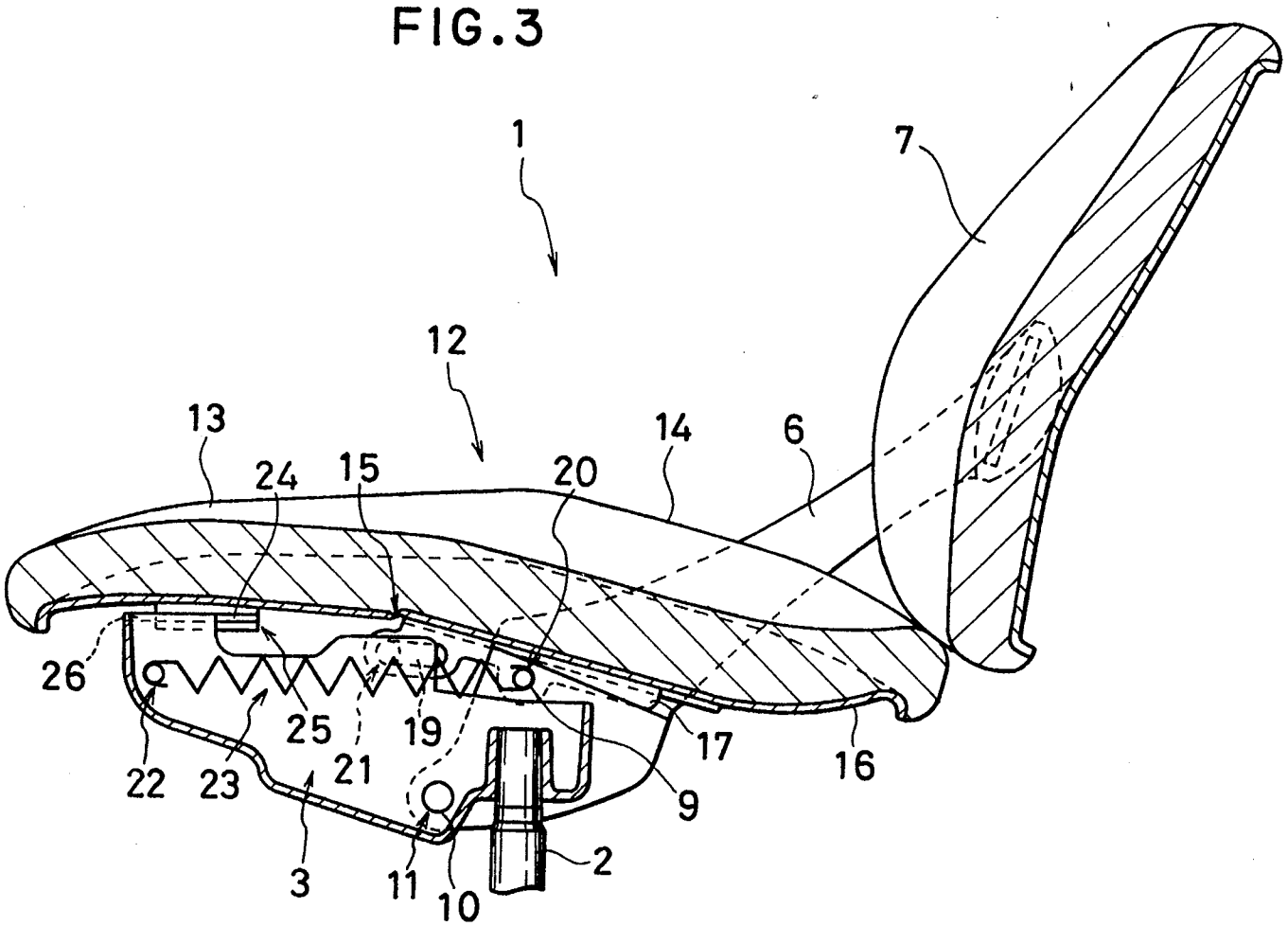
FIG. 3 is a side sectional view of the chair corresponding to that in FIG. 1 showing a state that a person takes an easy posture.

When a person rests against the back rest 7 in order to shift from a working posture to an easy posture, the supporting lever 6 which is pivoted by the shaft 11 on the lower rear part of the base frame 3 turns and inclines backward against the spring member 23 (FIG. 3).

In association with the backward inclination of the back rest 7, the rear seat 14 which is linked with the supporting lever 6 by the shaft 20 cooperates with the supporting lever 6 to gradually move backwards guided by the pin 21 and the slot 19 centering on the shaft 11 on the lower rear part of the base frame 3 as a fulcrum, and the front seat 14 guadually inclines backward bordering on the flexing part 15 which is situated almost at the center between the front and rear seats of the seat 12 until the pin 21 comes into abutment against the left end of the slot 19.

Owing to this movement, the load which is horizontally resolved forward of the sitting face by the load of the upper body part of a sitter is reduced, by which the buttocks are prevented from being pushed forward along the sitting face in accordance with the inclination of the back rest 7, that is, the buttocks of the sitter is stable supported on the rear seat part and hence the sitter can take the easy posture.

On the other hand, the front seat 13 is restricted by the flange 26 provided on the front part of the base frame and the slide fittings 25 with the back and forth extending elongated groove 24 attached to the seat receiving seating 16 so as to move almost horizontally.

Therefore, the front seat 13 is drawn by the rear seat through the flexing part 15 to move backward without inclining downward, so that the thigh does not incline downward but the leg inclines backward centering on the ankle as the fulcrum, by which the bending angle of the knee is increased and hence the sitter can sit on the chair comfortably in any posture ranging from the working posture to the easy posture.

Figure 4:
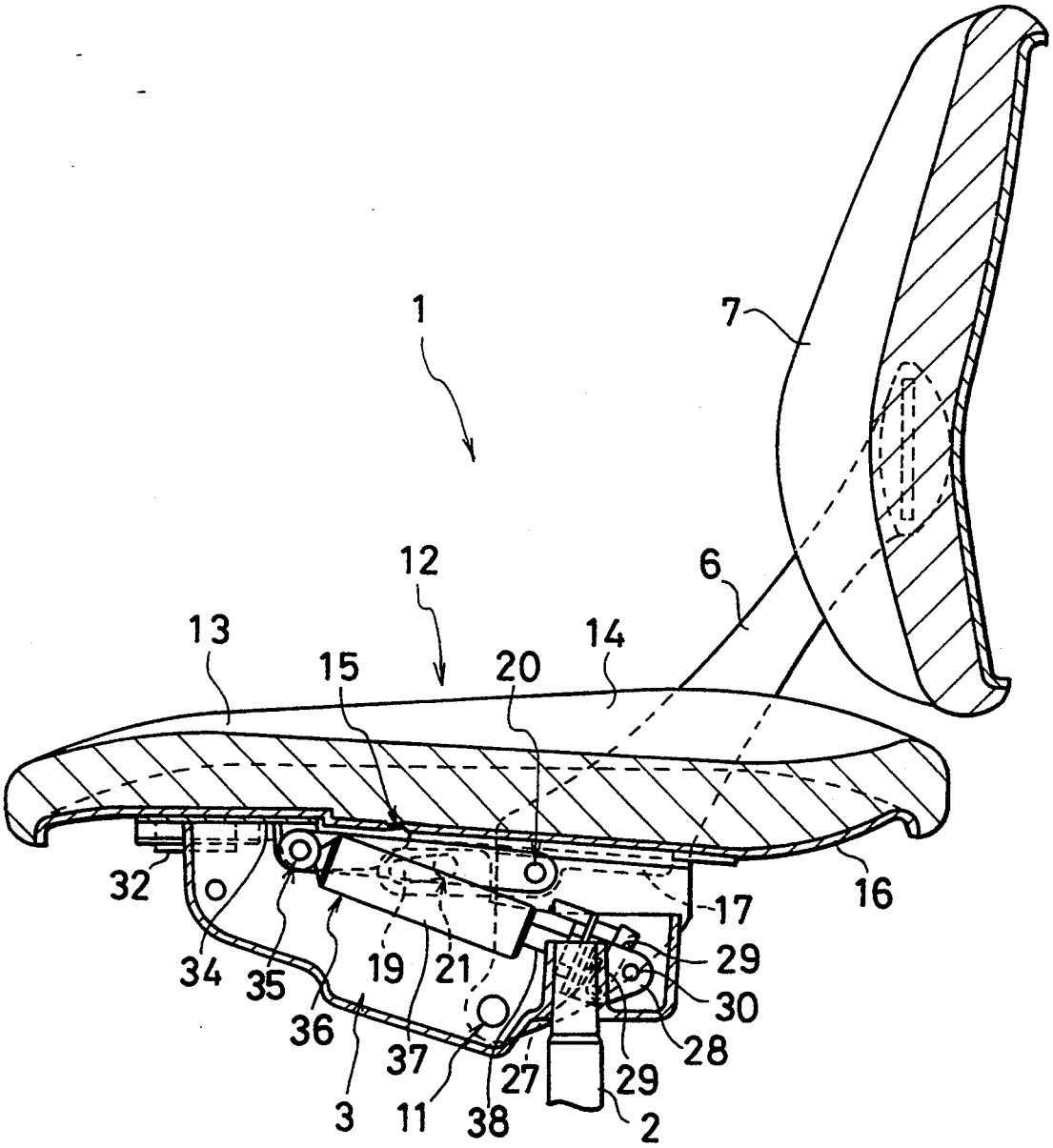
FIG. 4 is a side sectional view of the chair according to another embodiment of the present invention.
Figure 5:
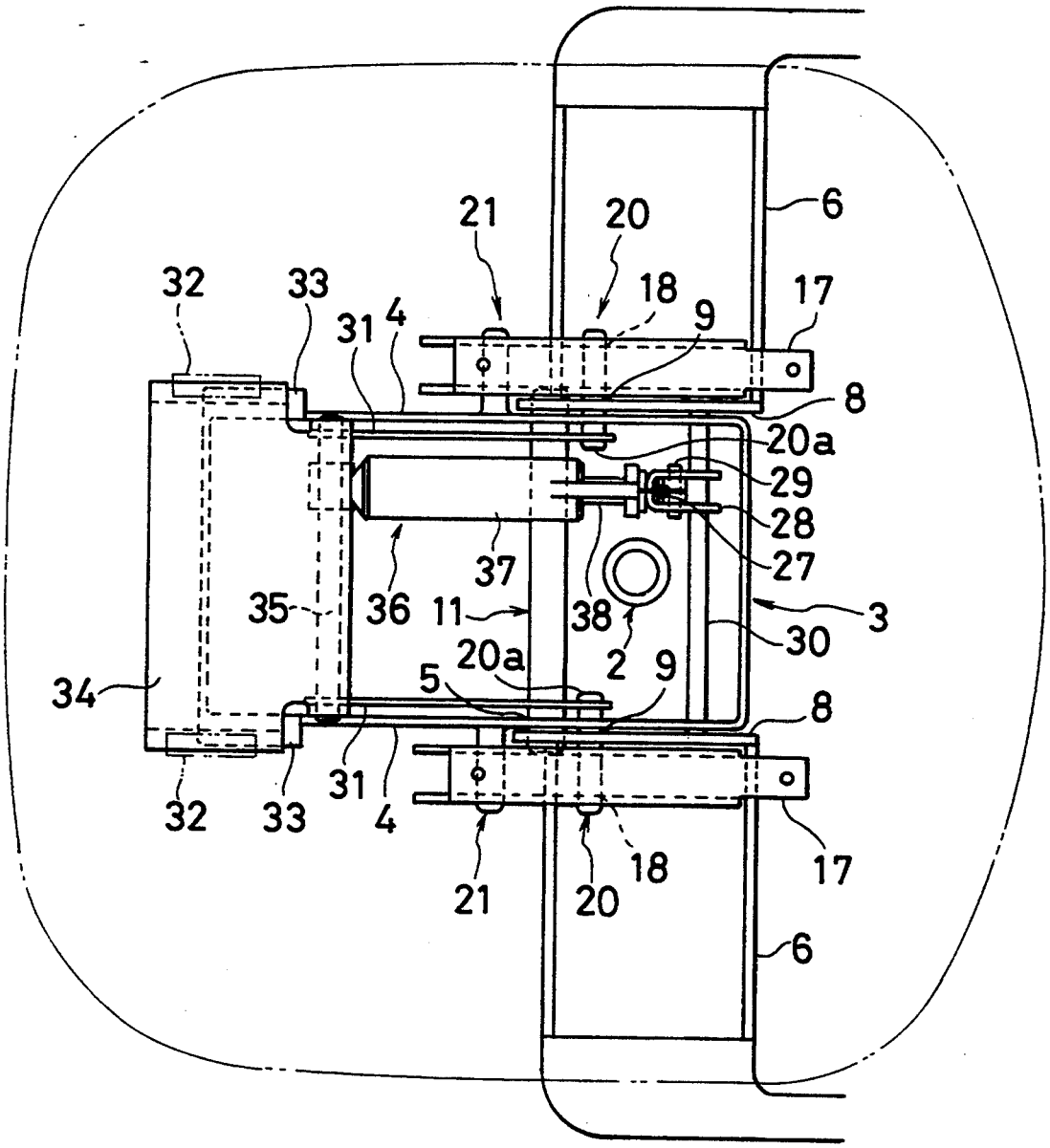
FIG. 5 is an essential plan view of the chair in Fig. 4.
Figure 6:
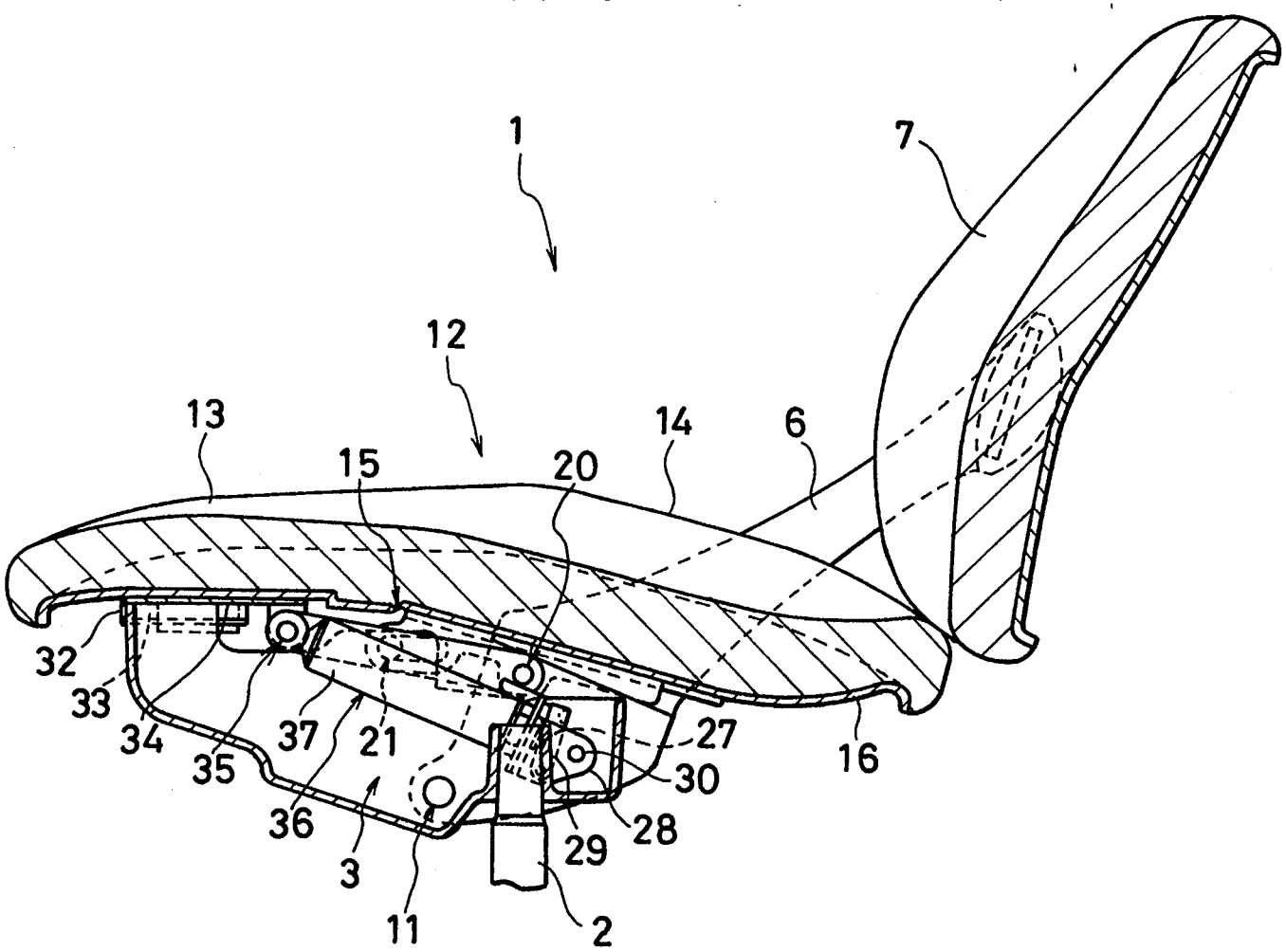
FIG. 6 is a side sectional view of the chair corresponding to that in FIG. 4 showing a state that a person takes an easy posture.

FIGS. 4 to 6 show another embodiment of the present invention which is of a gas spring type and hence only differences thereof from the above-mentioned embodiment will be described.

A front seat receiver 34 is attached to a front part of the seat receiving seating 16 and a shaft 35 is bridged between right and left sides of a rear part of the receiver 34.

A gas spring 36 consists of a cylinder 37, a piston rod 38 and a push valve 27, and a bracket 28 is attached at the tip of the piston rod 38. A lever 29 for opening and closing the push valve 27 is pivotally attached to the bracket 28.

When the push valve 27 which projects from the piston rod 38 fitted and inserted into the cylinder 37 is pressed by the lever 29, the gas spring 36 is unlocked, by which the piston rod 38 becomes free to advance or retreat, that is, when an external force acting on the cylinder 37 is greater than an inner gas pressure, the piston rod 38 is pressed into the cylinder 37, while when the external force is less than the inner gas pressure, the piston rod 38 is pushed out.

One end of the gas spring 36 is pivotally supported on a shaft 30 which is provided on a rear part of the base frame 3 and the other end thereof is pivotally supported on the shaft 35.

The numeral 31 denotes a coupling rod which is pivotally supported on the shaft 20 for pivotally supporting the supporting rod 6 and the rear seat 14 at one end thereof and is pivotally supported on the shaft 35 for pivotally supporting the gas spring 36 and the front seat 13 at the other end thereof.

Slide fittings 32 are attached onto the both sides of the front seat receiver 84 attached to the seat receiving seating 16 on the back surface of the front seat 13.

The slide fitting 32 is locked to a flange member 33 provided on a front part of the base frame 3 so as to be slidable back and forth.

Owing to the above-mentioned arrangement, the front seat 13 is locked so as to be movable back and forth almost horizontally back and forth.

Accordingly, in the ordinary position the working posture in which the back rest 7 is not inclined backward, the piston rod 88 of the gas spring 36 is in a projected state and the pin 21 is in abutment against the right end of the slot 19 as shown in FIG. 4.

Next, the operation of the embodiment will be described.

When a person rests against the back rest 7 by releasing the push valve 27 of the gas spring 36 in order to shift from the working posture to the easy posture, the supporting rod 6 which is pivotally supported by the shaft 11 on a lower rear part of the base frame 3 turns and inclines backward (FIG. 6 ).

In association with the backward inclination of the back rest 7, the rear seat 14 which is linked with the supporting rod 6 through the shaft 20 cooperates with the supporting rod 6 to move backward guided by the pin 21 and the slot 19 centering on the shaft 11 on the lower rear part of the base frame 3 as a fulcrum. Then, the rear seat gradually inclines backward bordering on the flexing part 15 which is situated almost at the center between the front and rear seats of the seat 12 until the pin 21 comes into abutment against the left end of the slot 19.

On that occasion, the piston rod 38 is pressed into the cylinder 37, so that the back rest 7 and the rear seat 14 incline backward while being exerted buffer action by the gas spring 36.

Owing to the above-mentioned backward inclination, the load which is resolved in a horizontal and forward direction of the sitting face by the load of the upper body part of the sitter is reduced, so that the buttocks are prevented from being pushed forward along the sitting face in accordance with the inclination of the backrest 7, by which the buttocks of the sitter are stably supported by the rear seat and sitter can take the easy posture.

In addition, a slide fitting 32 which is attached to the front seat receiver 22 on the back surface of the front seat 13 is fitted onto a flange member 33 provided on a front part of the base frame so as to be slidable back and forth, so that the front seat 13 is locked so as to be movable amlost horizontally only back and forth.

Owing to the above-mentioned operation, the front seat 13 does not incline downward but is drawn by the rear seat through the flexing part 15 to move backward, so that the thigh does not incline downward but the leg inclines backward centering on the ankle as the fulcrum, by which the bending angle of the knee is increased and hence the sitter can sit in a comfortable state in any posture ranging from the working posture to the easy posture.

The above-mentioned fact will be described with reference to FIGS. 7 and 8. In the conventional chair, as shown in FIG. 8, even when the back rest inclines backward, a force "f1" exerted on the sitting face by the load of the upper body part of the sitter does not act in a nearly vertical direction, so that a force f4 for shifting the buttocks forward along the sitting face is increased and hence the person can not take the easy posture.

Figure 7:
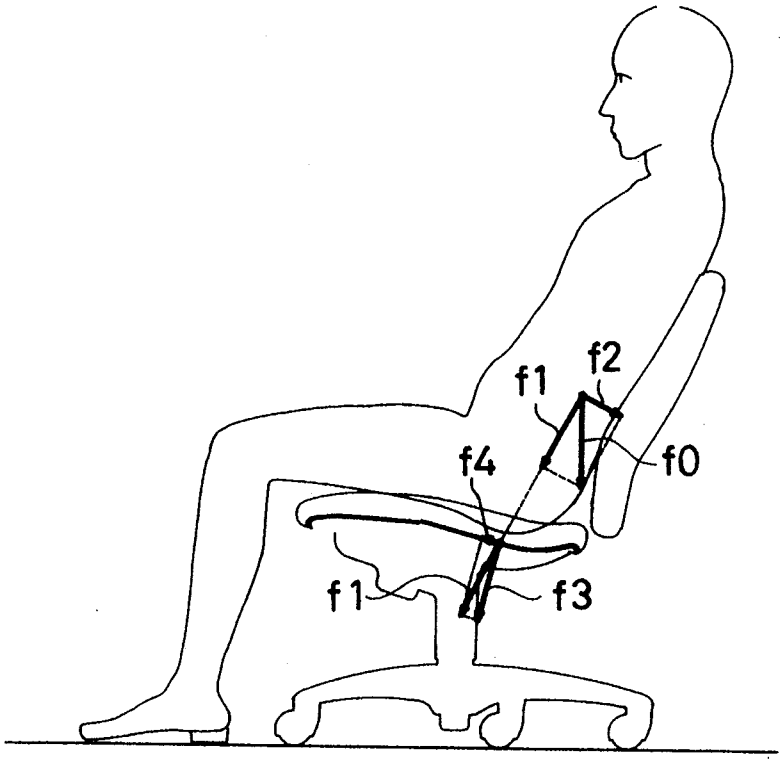
FIG. 7 is a diagram showing distribution of the load of the upper body part exerted in a state that a person takes an easy posture on the chair according to the embodiments of the present invention.
Figure 8:
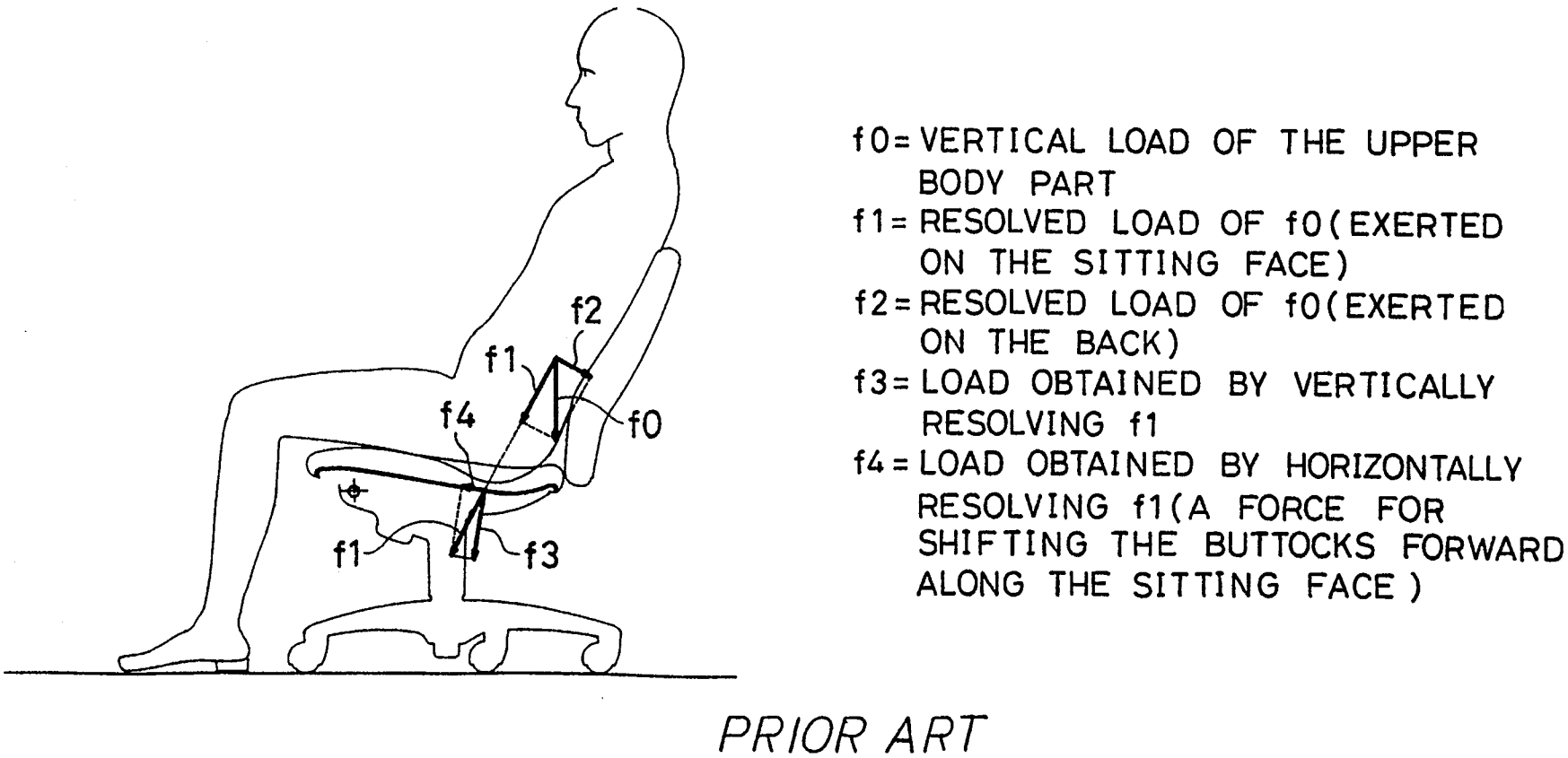
FIG. 8 is a diagram showing distribution of the load of the upper body part exerted in a state that the person takes the easy posture on a conventional chair.
Figure 9:
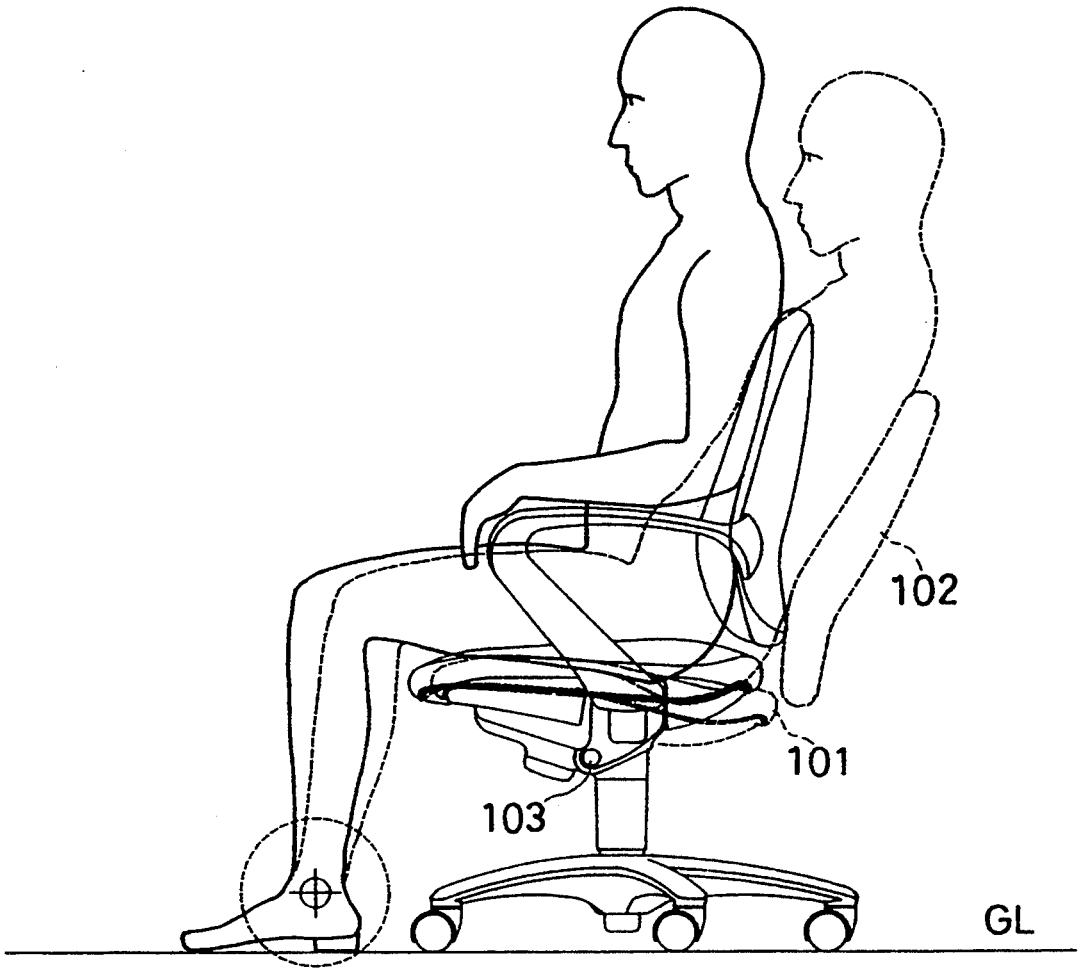
FIG. 9 is a diagram showing the working and easy postures on the conventional chair.

However, according to the present invention, as shown in FIG. 7, the rear seat 14 greatly inclines bordering on the amlost center part between the front and rear seats, so that the force f1 exerted on the sitting face acts in an almost vertical direction and hence the horizontal component of force f4 is considerably reduced, by which the person can take the stable easy posture.

The foregoing merely relates to embodiments of this invention, and any changes and modifications may be carried out by person skilled in the art within the scope of appended claims as follows:

What is claimed is:

1. A chair and comprising, a forward facing base frame fixedly mounted to an upper end of a pillar, a lower part of a supporting lever provided with a back rest movably and rotatably mounted on a lower rear part of said base frame by a shaft extending from one side of said chair to another side thereof, a seat including in succession a front seat portion and rear seat portion flexibly coupled together by a flexing part adjacent the center of said seat between the front and rear seat portions and being coupled to said supporting lever so as to cooperate therewith, and wherein said front seat portion is locked to a front part of said base frame so as to prevent inclining movement thereof but permit movement thereof only back and forth.

2. A chair according to claim 1, and further comprising, a seat supporting plate provided on a back surface of said seat, said plate having a flexible part adjacent a central portion thereof.

3. A chair according to claim 2, wherein said rear seat portion is constructed so as to be able to cooperate with said supporting lever and is centered on an axis which is coaxial with said supporting lever.

4. A chair according to claim 2, wherein a slide fitting is attached to a lower surface of said seat supporting plate on a front portion thereof so as to be slidable almost horizontally with respect to a flange which is provided on a front part of said supporting lever.

5. A chair according to claim 2, and further comprising a rear seat support attached to a lower surface of the seat supporting plate at a rear portion thereof, said rear seat support being pivotably mounted on said supporting lever.

6. A chair according to claim 5, wherein said rear seat portion is constructed so as to be able to cooperate with said supporting lever and is centered on an axis which is coaxial with said supporting lever.

7. A chair according to claim 5, wherein a slide fitting is attached to a lower surface of said seat supporting plate on a front portion thereof so as to be slidable almost horizontally with respect to a flange which is provided on a front part of said supporting lever.

8. A chair according to claim 1, wherein said rear seat portion is constructed so as to cooperate with said supporting lever and is centered on an axis which is coaxial with that of said supporting lever.

9. A chair according to claim 8, wherein a slide fitting is attached to a lower surface of said seat supporting plate on a front portion thereof so as to be slidable almost horizontally with respect to a flange which is provided on a front part of said supporting lever.

10. A chair according to claim 1, wherein a slide fitting is attached to a lower surface of a seat supporting plate on a front portion thereof so as t be slidable almost horizontally with respect to a flange which is provided on a front part of said supporting lever.

11. A chair, and comprising, a forward facing base frame fixedly mounted to an upper end of a pillar, a lower part of a supporting lever provided with a back rest movably and rotatably pivotably mounted on a lower rear part of said base frame by a shaft extending from one side of said chair to another side thereof, a seat including in succession a front seat portion and rear seat portion flexibly coupled together through a flexing part adjacent the center of said seat between the front and rear seat portions and being coupled to said supporting lever so as to be able to cooperate with said supporting lever, said front seat portion being locked to a front part of said base frame so as to prevent inclining movement thereof but allowing movement thereof only back and forth, and a return spring for making said supporting lever stand up, between said supporting lever and said base frame.

12. A chair according to claim 11, wherein an almost center part of a seat supporting plate is provided on a back surface of said seat and constitutes a flexible part.

13. A chair according to claim 12, wherein a rear seat support is attached to a lower surface of the seat supporting plate on a rear portion thereof and said rear seat support is pivotably mounted on said supporting lever.

14. A chair according to claim 13, wherein said rear seat portion is constructed so as to cooperate with said supporting lever and is centered on an axis which is coaxial with said supporting lever.

15. A chair according to claim 11, wherein said rear seat portion is constructed so as to be able to cooperate with said supporting lever and is centered on an axis which is coaxial with said supporting lever.

16. A chair according to claim 11, wherein a slide fitting is attached to a lower surface of said sat supporting plate on a front portion thereof so as to be slidable almost horizontally with respect to a flange which is provided on a front part of said supporting lever.

17. A chair, and comprising, a forward facing base frame fixedly mounted to an upper end of a pillar, a lower part of a supporting lever provided with a back rest movably and rotatably pivotably mounted on a lower rear part of said base frame by a shaft extending from one side of said chair to another side thereof, a seat including in succession a front seat portion and a rear seat portion flexibly coupled together by a flexing part adjacent the center of said seat between the front and rear seat portions, said flexing part being coupled to said supporting lever so as to be able to cooperate with said supporting lever, one end of a gas spring pivotably mounted on a rear part of said base frame and another end thereof pivotably mounted on the frame of said front seat portion, a lever for opening and closing a push valve of said gas spring, and wherein said front seat portion is locked to a front part of said base frame so as to prevent inclining movement thereof but permitting, movement thereof only back and forth.

18. A chair according to claim 17, and further comprising a coupling rod bridged between a shaft for pivotably supporting said gas spring and said front seat portion, and a shaft for pivotally supporting said supporting lever and said rear seat portion.

19. A chair according t claim 17 wherein an almost center part of a seat supporting plate is provided on a back surface of said seat and constitutes a flexible part.

20. A chair according to claim 19, wherein a rear seat support is attached to a lower surface of the seat supporting plate on a rear portion thereof and said rear seat support is pivotably mounted on said supporting lever.

21. A chair according to claim 20, wherein said rear seat portion is constructed so as to cooperate with said supporting lever and is centered on an axis which is coaxial with said supporting lever.

22. A chair according to claim 17, wherein said rear seat portion is constructed so as to be able to cooperate with said supporting lever and is centered on an axis which is coaxial with said supporting lever.

23. A chair according to claim 17, wherein a slide fitting is attached to a lower surface of aid seat supporting plate on a front portion thereof so as to be slidable almost horizontally with respect to a flange which is provided on a front part of said supporting lever.

* * * * *

UNITED STATES PATENT AND TRADEMARK OFFICE

CERTIFICATE OF CORRECTION

PATENT NO. : 5,335,969

DATED : August 9, 1994

INVENTOR(S) : Tomoshige YAMAGUCHI and Nobuaki NASU

It is certified that error appears in the above-indentified patent and that said Letters Patent is hereby corrected as shown below:

Claim 1, col. 6, line 33, "chair" should be --chair,--.

Claim 1, col. 6, line 36, after "rotatably" insert --pivotably--.

Claim 10, col. 7, line 18, "t" should be --to--.

Claim 16, col. 8, line 4, "sat" should be --seat--.

Claim 19, col. 8, line 32, "t" should be --to--.

Claim 23, col. 8, line 48, "aid" should be --said--.

Signed and Sealed this

Twenty-eight Day of March, 1995

*Attest:*

Bruce Lehman

BRUCE LEHMAN

*Attesting Officer*

*Commissioner of Patents and Trademarks*